United States Patent [19]

Bessen et al.

[11] 3,964,877

[45] June 22, 1976

[54] POROUS HIGH TEMPERATURE SEAL ABRADABLE MEMBER

[75] Inventors: Irwin I. Bessen; Robert K. Betts, both of Cincinnati; Robert V. Hillery, West Chester, all of Ohio

[73] Assignee: General Electric Company, Cincinnati, Ohio

[22] Filed: Aug. 22, 1975

[21] Appl. No.: 606,956

[52] U.S. Cl. ..... 29/182; 75/126 G; 75/126 H; 75/128 R; 75/128 B; 75/128 G; 75/171; 75/222; 415/174

[51] Int. Cl.[2] ..... C22C 1/04

[58] Field of Search ..... 29/182, 182.5; 75/222, 75/226, 126 G, 126 H, 128 B, 128 E, 171, 128 R; 415/174

[56] References Cited

UNITED STATES PATENTS

| | | | |
|---|---|---|---|
| 3,027,252 | 3/1962 | McGurty et al. | 75/176 X |
| 3,068,016 | 12/1962 | Dega | 415/174 X |
| 3,342,563 | 9/1967 | Butts | 29/182 |
| 3,540,862 | 11/1970 | Roemer | 29/182.5 |
| 3,542,530 | 11/1970 | Talboom, Jr. et al. | 75/126 X |
| 3,676,085 | 7/1972 | Evans et al. | 75/171 X |
| 3,754,902 | 8/1973 | Boone et al. | 75/171 |
| 3,754,903 | 8/1973 | Goward et al. | 75/171 |
| 3,807,993 | 4/1974 | Dalai et al. | 75/171 |
| 3,817,719 | 6/1974 | Schilke et al. | 29/182.5 |
| 3,832,167 | 8/1974 | Kershaw | 75/171 X |

*Primary Examiner*—Benjamin R. Padgett
*Assistant Examiner*—R. E. Schafer
*Attorney, Agent, or Firm*—Lee H. Sachs; Derek P. Lawrence

[57] ABSTRACT

A seal member is provided with an improved combination of oxidation resistance, fluid erosion resistance, reduced thermal conductivity and low flow stress at elevated temperatures through a plurality of metallurgically bonded metal alloy powder particles in the size range substantially of about +140 to about −270 ASTM (U.S. Standard Sieve) the metal particles being metallographically distinguishable and consisting essentially of, by weight, 15 – 35% Cr, about 8 to 20% Al, up to 5% of elements selected from Y, Hf and the rare earth elements, with the balance selected from Fe, Co and Ni, the member having a density in the range of about 65 – 90% of theoretical density.

5 Claims, 7 Drawing Figures

Ni-22 Cr-10Al-1Y (50X)

Fig 1a
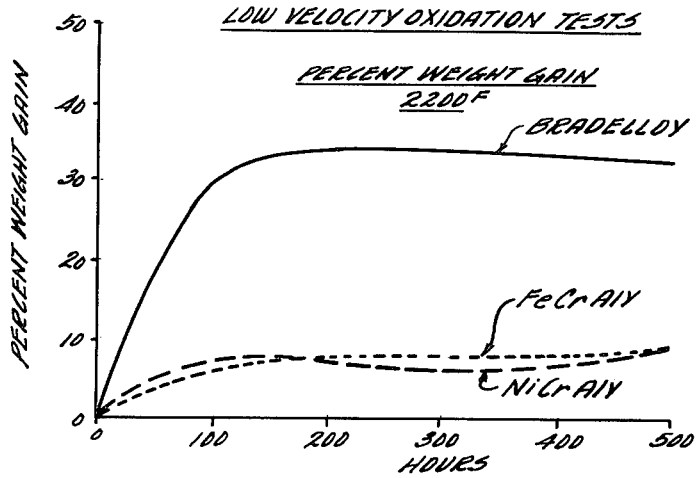
Fig 1b
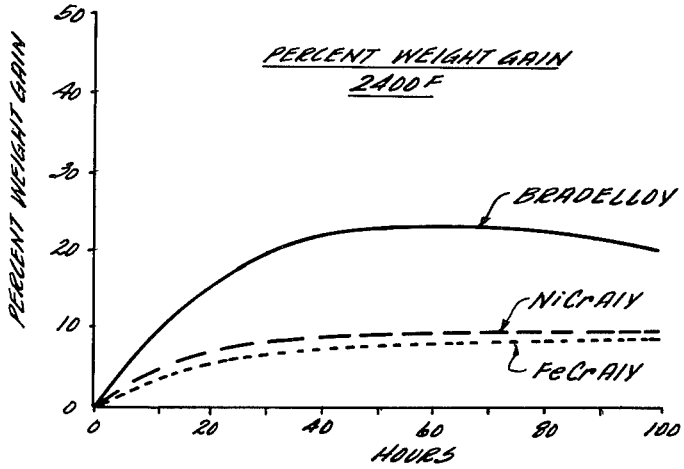
Fig 2a
Fig 2b
BRADELLOY MATERIAL (50X)
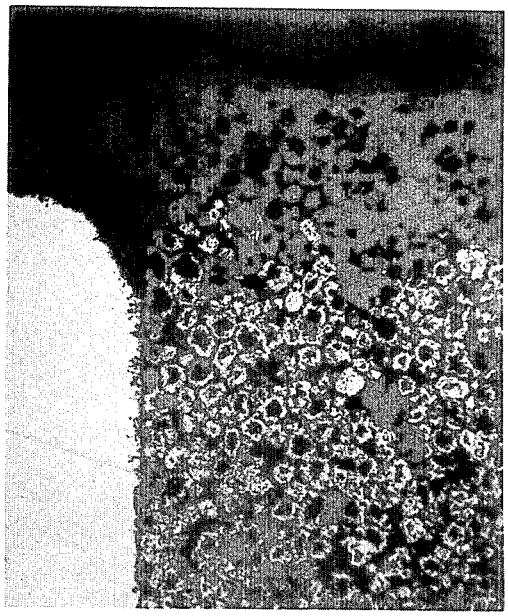
Ni-22 Cr-10Al-1Y (50X)
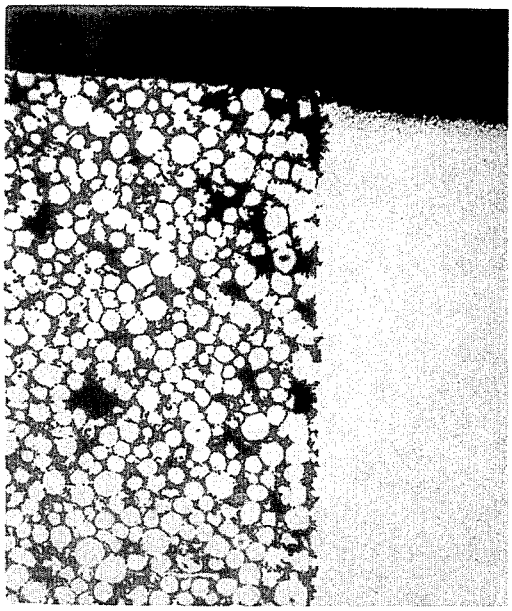

SURFACE RUB - 100X

POROUS HIGH TEMPERATURE SEAL ABRADABLE MEMBER

BACKGROUND OF THE INVENTION

This invention relates to high temperature seal members and, more particularly, to a high temperature seal material especially useful in the high temperature portions of gas turbine engines and having an improved combination of oxidation and gas erosion resistance, reduced thermal conductivity and low flow stress rather than abradability.

An important factor in the evolution of gas turbine engines has been the development of new turbine materials technology. The desire for increased turbine inlet temperatures has been persistent, resulting in the development of improved turbine blade and vane materials to withstand the more difficult conditions. Concurrently, improvements in turbine shroud materials are required not only to withstand the higher temperatures, but also to resist the more difficult oxidation and gas erosion conditions while assisting and improving the efficiency of the turbine.

Early forms of turbine shrouds were relatively simple metal rings that defined the outer gas envelope. Improved forms included open-face honeycomb, transpiration cooled materials as a result of air permeability through the material, and shrouds filled with various types of abradable, friable materials. One such shroud currently operating in commercial gas turbine engines is filled with a material sometimes referred to as Bradelloy material and is described in U.S. Pat. No. 3,342,563 — Butts, issued Sept. 19, 1967. This material has resulted in a reliable turbine shroud structure for current operating temperatures. However, it has been recognized that the higher temperatures and more difficult operating conditions found in advanced gas turbine engines will require an improved high temperature shroud member which is more oxidation and erosion resistant, and is substantially non-friable at intended operating temperatures. Thus it can flow or smear at elevated temperatures at the interface with a rubbing element such as a blade tip, to provide a smooth, highly finished, aerodynamically desirable surface.

SUMMARY OF THE INVENTION

It is a principal object of the present invention to provide an improved high temperature, porous, metallic seal member having an improved combination of oxidation and gas erosion resistance along with low elevated temperature flow stress, and controlled thermal conductivity.

A more specific object is to provide such a material which can be used as a turbine shroud material in gas turbine engines.

These and other objects and advantages will be more fully understood from the following detailed description, the drawing and the examples, all of which are intended to be representative of rather than in any way limiting on the scope of the present invention.

Briefly, the present invention in one form provides an improved porous high temperature seal member of a material characterized by an improved combination of oxidation and gas erosion resistance, and low flow stress at high temperature so that the material is substantially non-friable at such temperature. The member also has reduced thermal conductivity as a result of the porosity. It comprises a plurality of metallurgically bonded metal alloy powder particles, for example which might result from pressing and sintering, the particles being in the size range substantially of about +140 to about −270 ASTM (U.S. Standard Sieve) and being metallographically distinguishable as metal particles. The particles consist essentially of, by weight, 15–35% Cr, about 8–20% Al, up to 5% of one or more elements selected from Y, Hf and the rare earth elements, with the balance selected from Fe, Co and Ni, along with incidental impurities. The member has a density in the range of about 65–90% of theoretical density. In a preferred form, the metal particles consist essentially of, by weight, about 20–23% Cr, about 9–13% Al, along with 0.1–5% of either or both of Y and Hf, with the balance Ni and incidental impurities, the member having a density in the range of about 65–83% of theoretical. A specifically preferred particle composition consists essentially of, by weight, 21–23% Cr, 9–11% Al, 0.8–1.2% of Y or Hf or both with the balance essentially Ni and incidental impurities, with a density of about 70–83% of theoretical.

BRIEF DESCRIPTION OF THE DRAWING

FIGS. 1*a* and 1*b* are graphical comparisons of dynamic oxidation data at 2200°F and 2400°F, respectively;

FIGS. 2*a* and 2*b* are photomicrographs at 50 magnifications comparing, respectively, Bradelloy material and a Ni-22Cr-10Al-1Y alloy member within the scope of the present invention;

DESCRIPTION OF THE PREFERRED EMBODIMENTS

Figure 3:
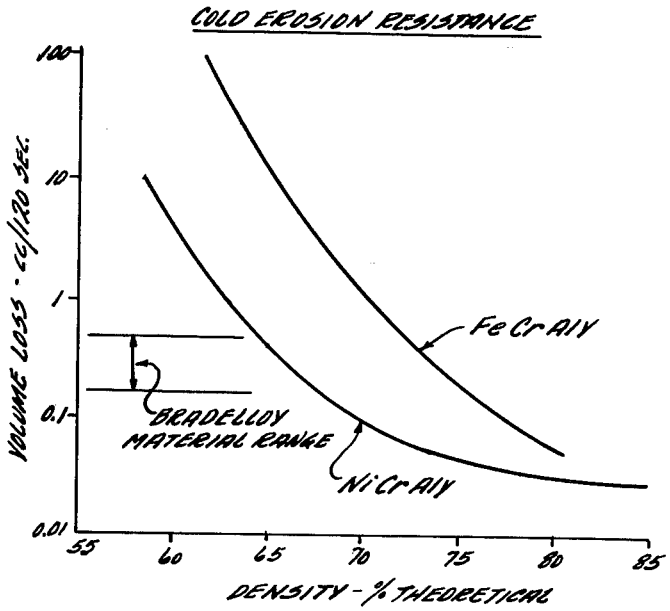
FIG. 3 is a graphical comparison of volume loss and density.

One important function of seal or shroud materials is to assist in maintaining the efficiency of gas turbine engines. This can be accomplished by controlling interstage leakage both in the compressor as well as in the turbine portion of the engine by minimizing, on a continuous basis, the clearance between rotating and stationary components, for example a rotating blade tip and a cooperating shroud. In the turbine, control of such clearance is particularly difficult because of the wider range of temperatures through which the turbine portion operates during an engine cycle from start-up to shut-down. Use of abradable shroud materials, such as honeycomb or abradable inserts or their combinations, allows a rotating component such as a blade tip to generate a path in the abradable material provided clearances and the relative coefficients of expansion are adjusted properly. The known solid or porous abradable materials achieve their abradability or friability through the inclusion of a variety of filler or "chip breaker" type materials, through provision of a brittle structure, through the provision of porosity, or their combinations.

One major problem involved with the use of an abradable shroud material at the temperatures experienced by the turbine section of a gas turbine engine in the oxidizing atmosphere in which it normally operates is the shroud material's oxidation which can result in a volume growth, spalling or break-down, and more rapid loss of the shroud material. This results in undesirable, large clearances and gas turbulence. Other problems involve the erosion and wear resistance of such an oxidized shroud material relative to that of a rubbing member, such as a rotating blade, its very low thermal conductivity when oxidized, leading to higher surface temperatures, and its thermal shock resistance. In addition, the oxidized, spalled, abraded, porous structure presents a rough flow path to the gas and results in undesirable gas turbulence.

The present invention provides an improved porous, high temperature, substantially non-friable seal member through the use of an oxidation resistant alloy in a particularly selected range, in the form of particularly sized powder, metallurgically bonded into a member of a critical density. Such an alloy composition is selected to provide a ductility which results in low flow stress, particularly at elevated temperatures, so that the alloy can be rubbed by a member such as a cooperating, rotating turbine blade and can flow or smear rather than crumble from such contact at the intended turbine operating temperature. The seal member formed from the alloy is provided with porosity to receive or capture rub debris which thus prevents the blade tips from scouring the seal material deeper than it would if the material were friable. In this way, there is provided a smooth aerodynamically attractive surface at the blade/seal interface. In addition, the porosity influences the thermal conductivity of the seal such that, for a shroud which is air-cooled from the back, the surface that gets rubbed is hotter than if it were fully dense, but not so hot as to accelerate oxidation. Also, the porosity introduces compliance that restricts the rubbing forces on the turbine blade tip.

More particularly, the combination of Ni with Cr, Al and preferably at least one element such as Y, Hf and the rare earth elements provides an improved oxidation base alloy from which the member of the present invention can be made. Such general combination of elements, based on one or more of the transition triad elements Fe, Co and Ni, have been reported as having improved oxidation resistance: in the form of structural alloys, for example as in U.S. Pat. No. 3,027,252 — McGurty et al; as a coating material as in U.S. Pat. No. 3,542,530 — Talboom, Jr. et al; and U.S. Pat. No. 3,676,085 — Evans et al; and in connection with a high temperature abradable material as in U.S. Pat. No. 3,817,719 — Schilke et al. The disclosures of each of these patents is incorporated herein by reference. Each of the uses of the combination of such elements involves different ranges with optional different other alloying elements to generate a particular article different from that of the present invention. The member of the present invention, though using the same general grouping of elements, is characterized by porosity and substantially non-friability at elevated temperatures. This is accomplished through the combination of a particular composition range along with a structure which is defined by the size of the powder particles from which it is made as well as by its density range based on percent of theoretical density. This combination provides an improved seal member such as for use as a shroud in a gas turbine engine having a significantly improved oxidation and gas erosion resistance along with good thermal shock resistance, higher compliance, and lower thermal conductivity than a fully dense member.

During the evaluation of the present invention, a variety of specimen members were prepared. Typical of these are the alloy powder compositions shown in the following Table:

TABLE

| Example | Cr | Weight % Al | Y | Hf | Balance |
|---|---|---|---|---|---|
| 1 | 25 | 10 | 1 | | Fe |
| 2 | 19.4 | 8.0 | .90 | | Ni |
| 3 | 19.6 | 10.0 | 1.45 | | Ni |
| 4 | 22.2 | 10.1 | .95 | | Ni |
| 5 | 23.0 | 12.7 | .64 | | Ni |
| 6 | 20 | 10 | | 3 | Ni |

For evaluation of members according to the present invention, specimen members were prepared by selecting pre-alloyed powders or particles in the size range of about +140 to about −270 ASTM (U.S. Standard Sieve), placing the alloy powder within a shroud shell having a backing portion and side portions to retain the powder and then applying sufficient pressure and heat in a non-oxidizing atmosphere to metallurgically bond or sinter the alloy particles while maintaining metallographic distinction between the particles. In this series of evaluations, the pressure was applied in the range of about 100–2500 psi, depending upon the density desired, at a temperature of 1800°–2200°F (980°–1200°C). Although the present invention has recognized that a density in the range of about 65–90% and particularly 65–83% of theoretical density is particularly advantageous, densities of from about 60 to about 90% of theoretical were evaluated. The selection of the size of powder, according to the present invention, allows one to maintain desired porosity for the control of thermal conductivity and to allow capture of rub debris. This, coupled with the ductility of the alloy powder, provides the member of the present invention with compliance to enable a smooth surface to result from a rub such as might occur in a gas turbine engine from a cooperating, opposed turbine blade. If the size of powder is too large, the resulting porosity is too great. In addition, the load required to compact the member is inordinately large. Conversely, if the size of the powder is too small, the result is a compact which is too dense to accomplish the purposes of the present invention, and is more easily oxidized.

Free-standing compacts of the alloy compositions of Examples 1 and 2 of the Table, consisting nominally in percent by weight of Fe 25Cr 10Al 1Y and Ni 20Cr 8Al 1Y prealloyed powders, were hot pressed and evaluated in cyclic, dynamic oxidation tests (0.05 Mach) at 2200°F (1200°C) and 2400°F (1316°C). Parabolic rate curves for weight gain vs. time were obtained for such compositions. Comparison to the above-mentioned Bradelloy material (average composition of Ni-12 weight percent Al) is shown in FIGS. 1*a* and 1*b*. Microstructures of tested specimens showed that the Bradelloy material was essentially all converted to oxide in 110 hours at 2200°F (1200°C) and in 30 hours at 2400°F (1316°C), while the FeCrAlY and NiCrAlY structures were sintered metallic particles enclosed by a thin protective oxide layer.

The weight gains were manifest by a volume expansion of the material due to conversion of metal to oxide. The Bradelloy material volume growth was large relative to that of the FeCrAlY and NiCrAlY free-standing compacts. However, in actual engine shroud segments which are air-cooled from the back, the oxidation and volume growth are limited to the hotter gas path surface regions. Metallographic studies disclosed that a change occurs in the protective oxide thickness in NiCrAlY particles in an engine-run shroud from the air-cooled backing support to the gas path surface. Near the gas path surface, the oxide thickness was $3\times10^{-4}$ inches; near the backing, the oxide thickness was $5\times10^{-5}$ inches. Distortion was small. A Bradelloy material shroud in the same test engine showed spalled regions and excessive volume growth above the cavity sidewalls. FIGS. 2*a* and 2*b* compare the Bradelloy material (FIG. 2*a*) and a member of the present invention (FIG. 2*b*) of NiCrAlY alloy of Example 4 consisting nominally, in percent by weight, of Ni 22Cr 10Al 1Y.

It is also apparent from this comparison that one role of controlled porosity in such shrouds is to establish an appropriate temperature drop between the gas path surface and the air-cooled backing shell. An appropriate condition is one that avoids too high a gas path surface temperature which could accelerate surface oxidation, and that avoids too high a temperature on the superalloy support segment or backing, lest excessive cooling air be required to prevent creep of the support segment. Increasing cooling air reduces engine performance.

NiCrAlY alloy powder particles substantially in the size range of about +140 to about −270 ASTM (U.S. Standard Sieve), of the alloy of Example 4 in the Table, consisting nominally, by weight, of 22% Cr, 10% Al, 1% Y and the balance Ni, were hot pressed into nickel-base superalloy shroud support segments, the superalloy being of the commercially available form sometimes referred to as Rene' 77 alloy. The segments were then cut to appropriate size and tested in a Mach 0.8 cycled gas burner rig at a 30° impingement angle. Tests were conducted at 2100°F (1150°C) and 2200°F (1200°C) along with Bradelloy material specimens for comparison. The specimens were cycled to about 200°F (93°C) abruptly once an hour, then abruptly heated to the test temperature. The NiCrAlY material showed negligible gas erosion while the Bradelloy material specimens were substantially oxidized and eroded, as observed by metallographic examination.

For a more quantitative evaluation of the erosion resistance of the present invention, similar hot pressed specimens were evaluated in a particle erosion test as a function of density. This test had been correlated to gas turbine engine erosion losses for Bradelloy material. It also presents the effects of erosion from ingested particles or from rub debris. The test uses 750 grams of 50 micron size $Al_2O_3$ particles flowed through a circular 0.2 inch diameter nozzle under 60 psi pressure drop. The nozzle-to-specimen distance was maintained at 6 inches. The variation of erosion volume loss compared with density for hot pressed specimens and for hot pressed and oxidized specimens is summarized in the graphical presentation of FIG. 3 using the FeCrAlY material of Example 1 and the NiCrAlY material of Example 4 of the Table. It is apparent that the best erosion resistance lies in a range of about 65% or greater density for the member made from the NiCrAlY alloy and about 73% or better density for the material made from the FeCrAlY material. Individual points from which the graphical presentation of FIG. 3 was prepared showed that thermal exposure improves the erosion resistance of the members made both from the FeCrAlY and NiCrAlY materials.

Figure 4:
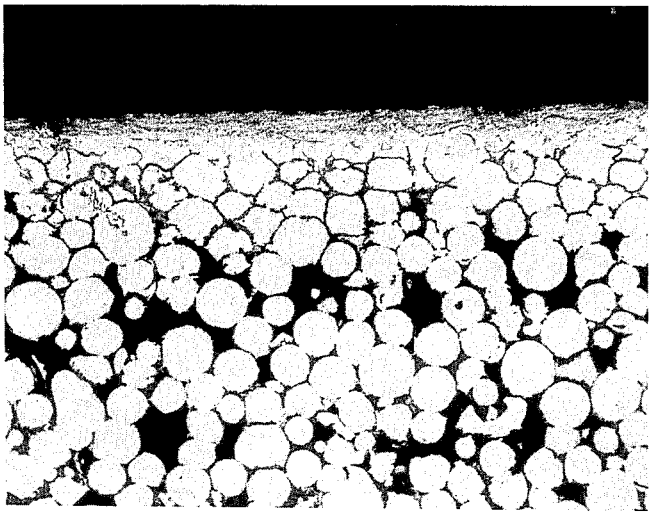
FIG. 4 is a photomicrograph at 100 magnifications of a member of the present invention after experiencing a surface rub.

Superalloy shroud segments of the above-mentioned Rene' 77 alloy were filled with the FeCrAlY alloy of Example 1 and the NiCrAlY alloy of Example 4 by hot pressing to an average density of about 75% of theoretical. Specimens were then exposed for 16 hours at 1800°F (982°C) as a simulated exposure. The specimens were then mounted in a full size shroud support structure, machined to diameter, and clearances set relative to a full scale turbine rotor. The rotor blades of a commercially available nickel-base superalloy sometimes referred to as Rene' 80 alloy were driven to a tip speed of 1440 feet per second, and then a rub was produced by hydraulic actuation of the entire shroud support in a radial direction. In the test series, the incursion was set for depths of 5–15 mils at rates of 1 mil/sec and 20 mil/sec. In these tests, all of the wear occurred on the shrouds, and the turbine blades did not wear. The rubbed surface of the shroud had smeared, i.e., flowed plastically. The pores near the rubbed surface "captured" deformed metal, leaving the surface smooth and aerodynamically favorable as shown in the photomicrograph of FIG. 4 at 100 magnifications.

Similar shroud segments filled with the NiCrAlY material of Example 4 were mounted in a commercial aircraft gas turbine test engine which was operated through 500 severe test cycles of a nature known to accelerate engine degradation relative to normal airline service. Light rubs produced in this test smeared the surface of the shrouds by deforming it plastically. Such rub material was captured within the pores near the surface and the compliance of the material of the present invention permitted a compression or densification of surface regions to accommodate the rotating turbine blades. Spectrographic analysis showed no blade metal was transferred to the shroud. Such transfer normally produces, in other shroud materials, a thick scab or nugget derived from continuing metal transfer from the blades as they pass over the scab. Work hardening and oxidation effectively produces from the scab a "coating tool" that then grooves the blade tips. In the test engine with the NiCrAlY member shrouds, scabs and metal transfer from blade tips were noticeably absent.

The present invention's compliance feature that accommodates rotating blades with a "soft" rub results from a low modulus of elasticity relative to fully dense materials. The modulus for the porous NiCrAlY shroud members of the present invention is in the range of 2–3.5 million psi, about an order of magnitude less than fully dense alloys.

Figure 5:
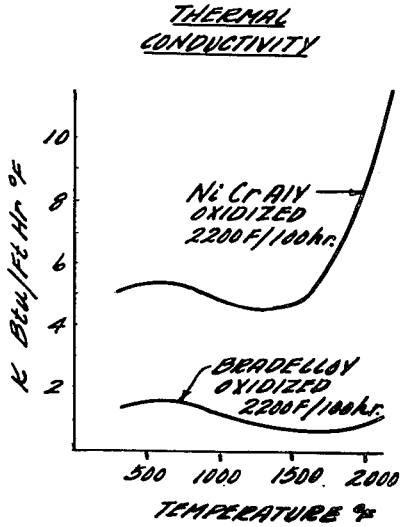
FIG. 5 is a graphical presentation of thermal conductivity as a function of temperature for one form of the present invention compared with a known member.

The controlled thermal conductivity of the present invention is used to balance the gas path surface temperatures with the shroud support temperatures through a selected porous structure that maintains a significant temperature drop. The graphical presentation of FIG. 5 shows the measured thermal conductivity as a function of temperature for a 75% dense sintered member of the present invention of the composition of Example 4 of the Table, after some air oxidation, compared with that of the Bradelloy material. Such NiCrAlY member, by comparison with Bradelloy material, has the capability of keeping its gas path surface cooler at high temperatures by virtue of a higher conductivity, thus limiting the oxidation rate at the surface and retaining its resistance to gas erosion.

From these representative data, it can be seen that the present invention provides an improved porous member of unexpectedly unique characteristics for use as a high temperature seal member, even though the general grouping of elements used in the alloy of the member are known. Along with the critical composition range is the specification of the size of the metal alloy particles for density control. Percent of theoretical density is specified for control of thermal conductivity, to provide the capability of capturing rubbed debris and to introduce compliance that restricts the rubbing forces on the turbine blade tip. Selection of the alloy composition to provide ductility and result in low flow stress, particularly at elevated temperatures, allows the member of the present invention to be rubbed by a cooperating, opposing member such as a rotating turbine blade of a gas turbine engine, to result in a smooth, aerodynamically attractive surface. Thus, it will be understood by those skilled in the art the variations and modifications of which the present invention is capable without departing from its broad scope.

What is claimed is:

1. An improved porous high temperature member having an improved combination of oxidation and erosion resistance, controlled thermal conductivity and low elevated flow stress which provides, upon rubbing contact with another member, a compliant base and a flowed, substantially continuous facing, the member comprising:

a plurality of metallurgically bonded, metallographically distinguishable metal alloy powder particles substantially in the size range of about +140 to about −270 ASTM (U.S. Standard Sieve);

the alloy of the metal particles consisting essentially of, by weight, 15–35% Cr, 8–20% Al, up to 5% of one or more elements selected from the group consisting of Y, Hf and the rare earth elements, with the balance selected from the group consisting of Fe, Co and Ni and incidental impurities;

the member having density in the range of about 65–90% of theoretical density established by the inclusion of pores.

2. The member of claim 1 in which the alloy of the metal particles consists essentially of, by weight, 20–23% Cr, 9–13% Al, 0.1–5% of one or more elements selected from the group consisting of Y and Hf with the balance essentially nickel;

the member having a density in the range of about 65–83% of theoretical density.

3. The member of claim 2 in which:

the alloy of the metal particles consists essentially of, by weight, 21–23% Cr, 9–11% Al, 0.8–1.2% of one or more elements selected from the group consisting of Y and Hf, with the balance essentially nickel;

the member having a density in the range of about 70–83% of theoretical density.

4. The member of claim 3 in which the alloy of the metal particle consists nominally, by weight, of 22% Cr, 10% Al, 1% Y, with the balance essentially nickel.

5. The member of claim 1 in which the alloy of the metal particles consists nominally, by weight, of 25% Cr, 10% Al, 1% Y, with the balance essentially Fe;

the member having a density in the range of about 75–90% of theoretical density.

* * * * *